US005550433A

United States Patent [19]

Tobler

[11] Patent Number: 5,550,433

[45] Date of Patent: Aug. 27, 1996

[54] DRIVER CIRCUIT FOR DISCHARGE LAMPS

[75] Inventor: Felix Tobler, Schanis, Switzerland

[73] Assignee: Knobel AG Lichttechnische Komponenten, Ennenda, Switzerland

[21] Appl. No.: 421,922

[22] Filed: Apr. 14, 1995

[30] Foreign Application Priority Data

Apr. 15, 1994 [EP] European Pat. Off. ..... 94105853

[51] Int. Cl.[6] ..... H05B 39/00

[52] U.S. Cl. ..... 315/94; 315/106; 315/86; 315/88

[58] Field of Search ..... 315/86, 87, 88, 315/91, 92, 94, 89, 106

[56] References Cited

U.S. PATENT DOCUMENTS

| | | | |
|---|---|---|---|
| 3,356,891 | 12/1967 | Godard | 315/86 |
| 4,063,108 | 12/1977 | Klett et al. | 315/86 |
| 5,426,347 | 6/1995 | Nilssen | 315/86 |

FOREIGN PATENT DOCUMENTS

| | | |
|---|---|---|
| 0146683 | 7/1985 | European Pat. Off. . |
| 3432266 | 3/1985 | Germany . |
| 4100349 | 8/1991 | Germany . |

*Primary Examiner*—Frank Gonzalez
*Assistant Examiner*—Reginald A. Ratliff
*Attorney, Agent, or Firm*—Greenblum & Bernstein P.L.C.

[57] ABSTRACT

Driver circuit for discharge lamps. The driver circuit contains an inverter driving a lamp circuit with a discharge lamp and the current in the lamp circuit is measured as a voltage $U_{ILC}$ over a resistor, with a control circuit comprising a strike detector that determines if the lamp did strike during a start-up phase of the driver, and if not, the inverter is switched off, with the control circuit going into a monitoring state where it operates the inverter for short periods at regular intervals, and during each such period, the voltage $U_{ILC}$ is monitored to detect a removal or an insertion of a lamp, so that, once the lamp has been replaced, a new start-up phase begins.

17 Claims, 2 Drawing Sheets

DRIVER CIRCUIT FOR DISCHARGE LAMPS

CROSS REFERENCE TO RELATED APPLICATIONS

This application claims the priority of European Application No. 94 105 853.9, filed Apr. 15, 1994, the disclosure of which is incorporated herein by reference in its entirety.

BACKGROUND OF THE INVENTION

1. Field of the Invention

The invention relates to a driver circuit for discharge lamps and a method for operating same.

2. Discussion of the Background of the Invention and Material Information

European Patent Publication EP 146 683 describes a ballast or driver for discharge lamps where the inverter is switched off when a lamp is found to be permanently inoperative. After switching off the inverter, a DC-current flows through the lamp circuit, and since this current flows through a heating cathode of each lamp, it drops to zero as soon as a lamp is removed. This makes it possible to detect a lamp replacement by monitoring the current, such that the inverter can be restarted automatically once a lamp has been replaced.

This method has the disadvantage that it only monitors one of the electrodes of each lamp. Furthermore, it is not well suited for use in circuits in which the heating current is coupled inductively into the electrodes.

SUMMARY OF THE INVENTION

Hence, it is a general object of the invention to provide a driver circuit and a method for operating same that does not include the noted disadvantages while, at the same time, being easy to implement.

In order to implement these and still further objects of the invention, which will become more readily apparent as the description proceeds, a first embodiment of this invention pertains to a method for operating a driver circuit for discharge lamps. The driver circuit comprises an inverter driving a lamp circuit, wherein at least one discharge lamp is arranged in the lamp circuit. The method further comprises the steps of attempting to cause the at least one lamp to strike during a start-up phase, and if the start-up phase fails and the at least one lamp does not strike; performing repeated measurements during a monitoring phase. During each of the measurements, operating the inverter for a predetermined time interval; and measuring at least one voltage generated by the inverter in the lamp circuit during each of the measurements for detecting a removal or an insertion of the at least one lamp.

A variation of the first embodiment of the method of this invention includes, after a failure of the at least one lamp to strike during the start-up phase, continuing the monitoring phase until a removal and a subsequent insertion of the at least one lamp has been detected, and thereupon initiating the start-up phase.

Another variation of the first embodiment of the method of this invention further includes arranging a plurality of lamps in the lamp circuit, wherein, after a failure of at least one of the lamps to strike during the start-up phase, continuing the monitoring phase until a removal of at least one of the lamps is detected, thereupon continuing the measurement phase until all of the lamps are inserted, and thereupon initiating the start-up phase.

A further variation of the first embodiment of the method of this invention includes, measuring two voltages, at two different points in the lamp circuit, during each measurement.

A differing variation of the first embodiment of the method of this invention includes, during each measurement, operating the inverter to generate four pulses at a frequency of 50 Khz.

A further embodiment of this invention pertains to a driver for fluorescent lamps comprising a lamp circuit for driving at least one fluorescent lamp; an inverter for generating an alternating voltage in the lamp circuit; a lamp presence detector for monitoring a voltage at at least one reference point in the lamp circuit for determining a presence of the at least one lamp while the alternating voltage is applied to the lamp circuit and for generating a signal indicative of the presence of the at least one lamp. It further comprises a control circuit for controlling a start-up procedure for the at least one lamp and, if the start-up procedure fails, for intermittently operating the inverter and monitoring the signal from the lamp presence detector and for restarting the start-up procedure upon a replacement of the at least one lamp.

A variation of the further embodiment of the driver of this invention further includes, arranging the heatable lamp electrode and a resistor in series in the lamp circuit, with the voltage at the at least one reference point depending on a voltage drop across the resistor.

Another variation of the further embodiment of the driver of this invention further includes a transformer arranged in the lamp circuit, wherein a primary winding of the transformer is arranged in series with a first heatable lamp electrode and a secondary winding of the transformer is connected to a second heatable lamp electrode for inducing a heating current in the second heatable lamp electrode.

A further variation of the further embodiment of the driver of this invention includes a first resistor arranged in series with respect to the primary winding, wherein the lamp presence detector is utilized for determining a voltage drop across the first resistor.

A differing variation of the further embodiment of the driver of this invention includes a second resistor arranged at the second heatable lamp electrode and in series with respect to the at least one lamp; and a lamp current regulator for determining a lamp current by measuring a voltage drop across the second resistor.

Another variation of the further embodiment of the driver of this invention further includes the following components, with the components being consecutively arranged in series in the lamp circuit in the following order: a first heatable electrode of the lamp; a capacitor; a second heatable electrode of the lamp; and a resistor, wherein the at least one reference point is arranged between the second electrode and the resistor.

Yet another variation of the further embodiment of the driver of this invention further includes the following components, with the components being consecutively arranged in series in the lamp circuit in the following order: a first heatable electrode of the lamp; a capacitor; a first winding of a transformer; and a resistor, wherein a second winding of the transformer is arranged in series with respect to a second heatable electrode of the lamp and wherein a first reference point is arranged between the first winding of the transformer and the resistor.

Yet a further variation of the further embodiment of the driver of this invention includes a second reference point, with the second reference point being arranged between the first winding of the transformer and the capacitor.

Yet a differing variation of the further embodiment of the driver of this invention includes arranging two lamps in the lamp circuit and consecutively arranging the following components in series in the lamp circuit in the following order: a first heatable electrode of a first lamp; a capacitor; a first winding of a transformer; a first heatable electrode of a second lamp; and a resistor, wherein a second winding of the transformer is arranged in series with respect to both a second heatable electrode of the first lamp and a second heatable electrode of the second lamp and wherein a first reference point is arranged between the first heatable electrode of the second lamp and the resistor.

Still another variation of the further embodiment of the driver of this invention includes a second reference point, with the second reference point being arranged between the first winding of the transformer and the capacitor.

Still a further variation of the further embodiment of the driver of this invention includes arranging two lamps in the lamp circuit and further including consecutively arranging the following components in series in the lamp circuit in the following order: a first heatable electrode of a first lamp; a capacitor; a first winding of a first transformer; a first winding of a second transformer; and a resistor, wherein a second winding of the first transformer is arranged in series with respect to a second heatable electrode of the first lamp and a second heatable electrode of a second lamp, wherein a second winding of the second transformer is arranged in series with respect to a first heatable electrode of the second lamp, and wherein a first reference point is arranged between the first winding of the second transformer and the resistor.

Still a differing variation of the further embodiment of the driver of this invention includes a second reference point, with the second reference point being arranged between the first winding of the first transformer and the capacitor.

An additional variation of the further embodiment of the driver of this invention includes a transformer, wherein a first winding of the transformer is arranged in the lamp circuit and a second winding of the transformer drives an auxiliary circuit, wherein the at least one lamp comprises at least one heatable electrode arranged in the auxiliary circuit in series with respect to the second winding, and wherein the control circuit comprises means for determining a voltage drop across the first winding of the transformer.

Another embodiment of this invention pertains to a driver for fluorescent lamps comprising a lamp circuit for receiving at least one fluorescent lamp, the lamp circuit comprising a transformer and a resistor; an inverter for generating an alternating voltage in the lamp circuit; and a lamp presence detector for monitoring a voltage drop across the resistor for determining a presence of the at least one lamp while the alternating voltage is applied to the lamp circuit and for generating a signal indicative of the presence of the at least one lamp, wherein the resistor is arranged in series with respect to a primary winding of the transformer, between the primary winding and a ground potential, and wherein a secondary winding of the transformer is connected to a ground-side electrode of the at least one lamp for inducing a heating current in the ground-side electrode.

The intermittent operation of the inverter and the measurement of the voltage at the reference point allow a secure determination of the presence or absence of the at least one lamp while it is not necessary to couple a DC-current into the lamp circuit. Therefore, no special circuitry for the generation of a DC current is required.

By measuring a voltage in the lamp circuit itself, the need for additional expensive transformers, for generating a measurement voltage proportional to the lamp circuit current, is obviated.

Preferably, after a failure of the start-up phase, the removal of the lamp should be determined by repetitive measurements. As soon as the lamp has been removed, the installation of a new lamp should be monitored by further measurements, and only then, is a new start-up phase initiated.

During the measurements, the inverter is preferably operated at a frequency above the normal operational frequency of the lamps such that the lamp-voltage lies below that of the ignition voltage.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS AND BEST MODE

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

Figure 1:
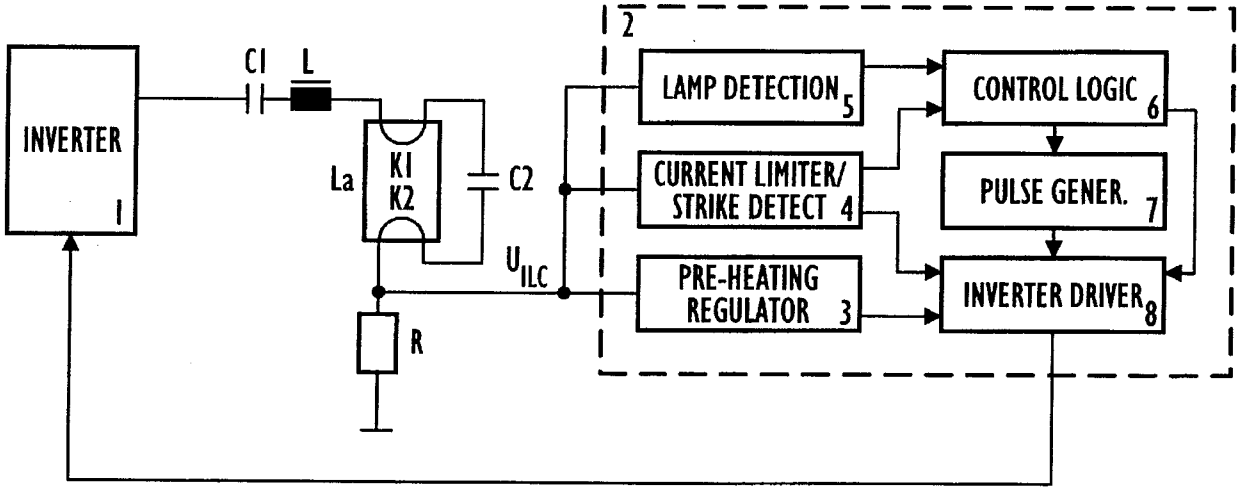
FIG. 1 is a simplified circuit diagram of a first embodiment of the invention.

A first embodiment of the invention is shown in FIG. 1 and shows a driver for a single fluorescent lamp La. The driver comprises a conventional inverter 1 driving a lamp circuit with an AC-current. The lamp circuit is comprised of a coupling capacitor C1, an inductance L, the fluorescent lamp La having heating cathodes K1 and K2, a parallel capacitor C2 and a resistor R. This circuit design is known to a person skilled in the art. A voltage $U_{ILC}$ is measured at a reference point above the resistor R, with this voltage being proportional to the current in the lamp circuit.

Voltage $U_{ILC}$ is fed to a control circuit 2 where it is monitored in a conventional way by a pre-heating regulator 3 and a current limiter/strike detector 4 that monitor the heating current and operating current of the lamp. In addition to this, voltage $U_{ILC}$ is fed to a lamp detector 5.

The control circuit 2 is further comprised of a control logic 6, a pulse generator 7 and an inverter driver 8.

When the lamp driver is switched on, control logic 6 and inverter driver 8 are in start-up mode and operate inverter 1 through a start-up phase, where the heating cathodes K1, K2 of the lamp are first pre-heated at a high inverter frequency.

Then, the inverter frequency is lowered to increase the voltage over the lamp until it strikes. Once lamp La strikes, control circuit 2 goes into operational mode and operates inverter 1 at substantially constant frequency to keep lamp La burning.

If the current limiter/strike detector 4 finds that the lamp La did not strike after a predefined time, control logic 6 goes into a monitoring mode and switches off inverter 1 to prevent undesired flickering and unnecessary wear of the driver. Then, control logic 6 starts a pulse generator 7, which issues four pulses at a frequency of 50 Khz every 20 milliseconds. These pulses are applied to inverter driver 8 and cause corresponding AC-current bursts to be generated by inverter 1. Each current burst is fed to the lamp circuit and activates it for a short measurement phase.

During each such measurement phase, lamp detector 5 determines the voltage $U_{ILC}$. As long as lamp La lies in the lamp circuit and its heating cathodes K1 and K2 are intact, the AC-burst generated by inverter 1 flows through capacitor C1, inductance L, heating cathode K1, capacitor C2, heating cathode K2 and resistor R and causes a non-zero voltage $U_{ILC}$. As soon as lamp La is removed, the current through the lamp circuit is interrupted and voltage $U_{ILC}$ becomes zero. Therefore, a removal of the lamp can be detected by monitoring voltage $U_{ILC}$. For this purpose lamp detector 5 compares voltage $U_{ILC}$ to a threshold value and, if voltage $U_{ILC}$ is smaller that this threshold value, lamp La is assumed to be missing.

When lamp detector 6 detects a removal of the lamp, the measuring phases are continued. Once a new lamp La has been inserted, voltage $U_{ILC}$ increases again thus informing lamp detector 5 that another lamp has been installed. A corresponding signal is sent to control logic 6, which initiates a new start-up phase.

As compared to conventional solutions, the driver of FIG. 1 is very simple since the voltage $U_{ILC}$ must already be measured for monitoring both the lamp current and the pre-heating current. Therefore, no new components are required in the lamp circuit.

Lamp detector 5, control logic 6 and pulse generator 7 can e.g. be part of an integrated circuit.

Figure 2:
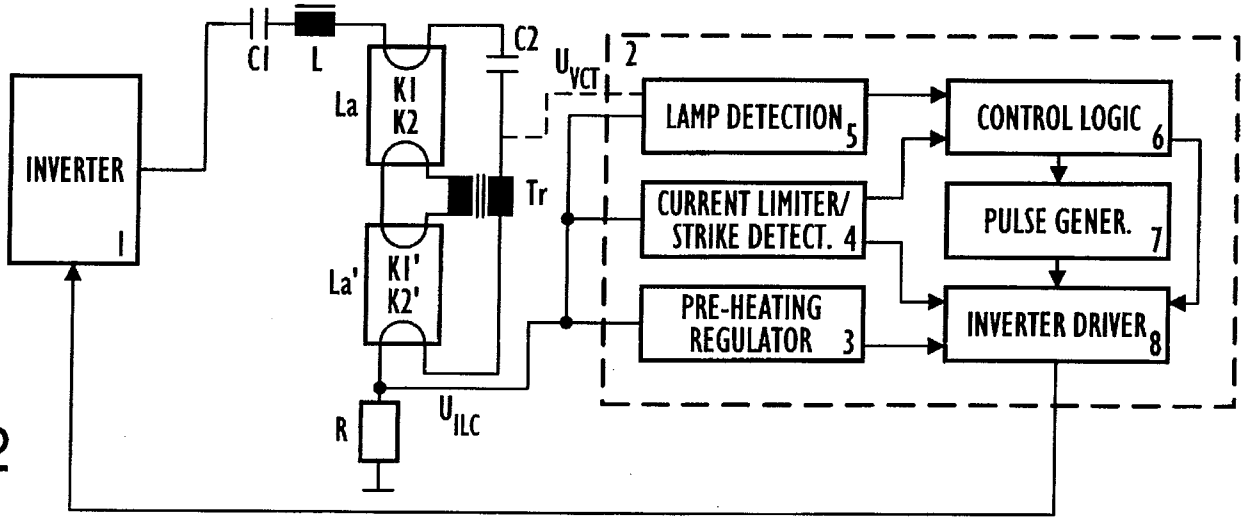
FIG. 2 is a simplified circuit diagram of a second embodiment of the invention.

As shown in FIG. 2, the inventive driver can also be used for two fluorescent lamps La, La'. These lamps are arranged in series with their two joined electrodes K1', K2 being heated by means of a transformer Tr having a transformation ratio of 1:1.

The driver of FIG. 2 is controlled in the same way as the driver of FIG. 1. A failure of one of the lamps to strike during start-up is again detected by the current limiter/strike detector 4, whereupon control circuit 2 goes into monitoring mode and starts issuing pulse bursts for driving inverter 1 during short, repetitive measurement phases.

Again, voltage $U_{ILC}$, at a reference point above resistor R, is monitored for detecting the removal or installation of one of the lamps. If one of the lamps La, La' is missing, the missing cathode K1 or K2', respectively, interrupts the lamp circuit and voltage $U_{ILC}$ becomes zero.

For improving the reliability of the lamp detector, a second voltage $U_{VCT}$ can be measured at a second reference point above transformer Tr, and voltage $U_{VCT}$ can be used to monitor the operation of cathodes K1' and K2. If one of these cathodes is not inserted correctly or if it is broken, no current is drawn from the secondary windings of transformer Tr. This increases the impedance of transformer Tr and therefore the voltage $U_{VCT}$ at the second reference point during the measurement phases. Therefore, the correct operation and presence of cathodes K1' and K2 can be monitored in lamp detector 5 by comparing voltage $U_{VCT}$ with a second threshold voltage.

When voltages $U_{VCT}$ and $U_{ILC}$ are used for monitoring the lamps, lamp detector 5 indicates that a lamp is missing if voltage $U_{ILC}$ is smaller than a first threshold value or voltage $U_{VCT}$ is larger than a second threshold value.

Figure 3:
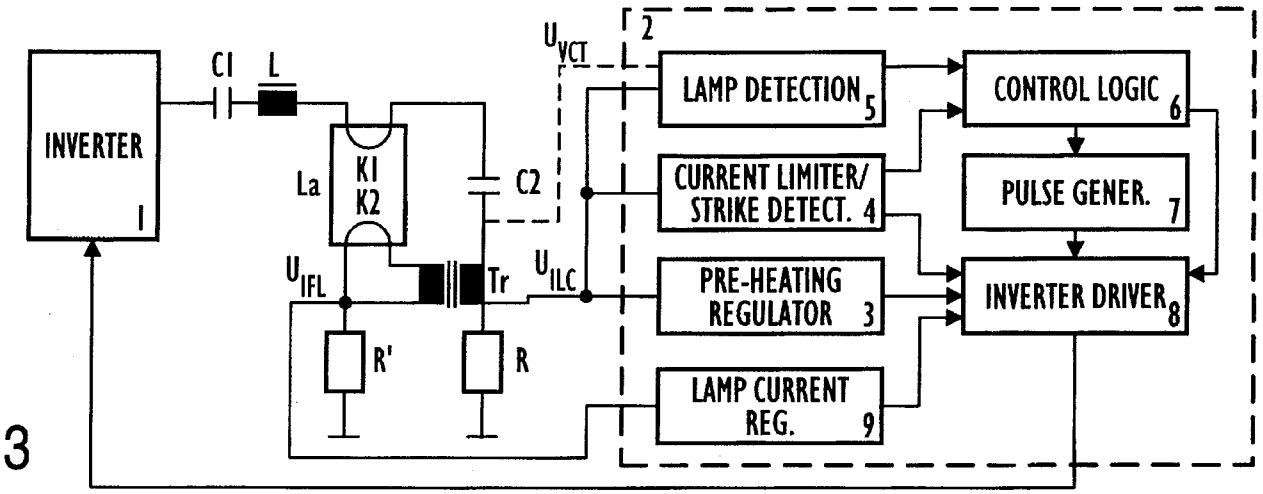
FIG. 3 is a simplified circuit diagram of a third embodiment of the invention.

The circuit of FIG. 3 shows a driver for a single lamp, the ground electrode K2 of which is heated inductively by means of a transformer Tr having a transformation ratio of 1:1. This allows a separate measurement of the lamp current and the heating current. The lamp current is manifested by a voltage drop $U_{IFL}$ over resistor R'. The heating current is manifested by a voltage $U_{ILC}$ over resistor R.

Control circuit 2 of FIG. 3 is substantially identical to control circuit 2 of FIGS. 1 and 2. The lamp current is regulated by feeding the voltage $U_{IFL}$ to a lamp current regulator 9. The voltage $U_{ILC}$, measured at a reference point above resistor R, is fed to the current limiter/strike detector 4, the pre-heating regulator 3 and the lamp detector 5. In addition thereto, a second voltage $U_{VCT}$ can be measured at a second reference point above transformer Tr, with this voltage depending on the current flowing through cathode K2 of lamp La.

If voltage $U_{VCT}$ is not used, lamp detector 5 detects the absence of lamp La by testing if voltage $U_{ICL}$ is smaller than a first threshold value. If voltage $U_{VCT}$ is used, lamp detector 5 detects the absence of lamp La by testing if voltage $U_{ICL}$ is smaller than a first threshold value or voltage $U_{VCT}$ is larger than a second threshold value.

Figure 4:
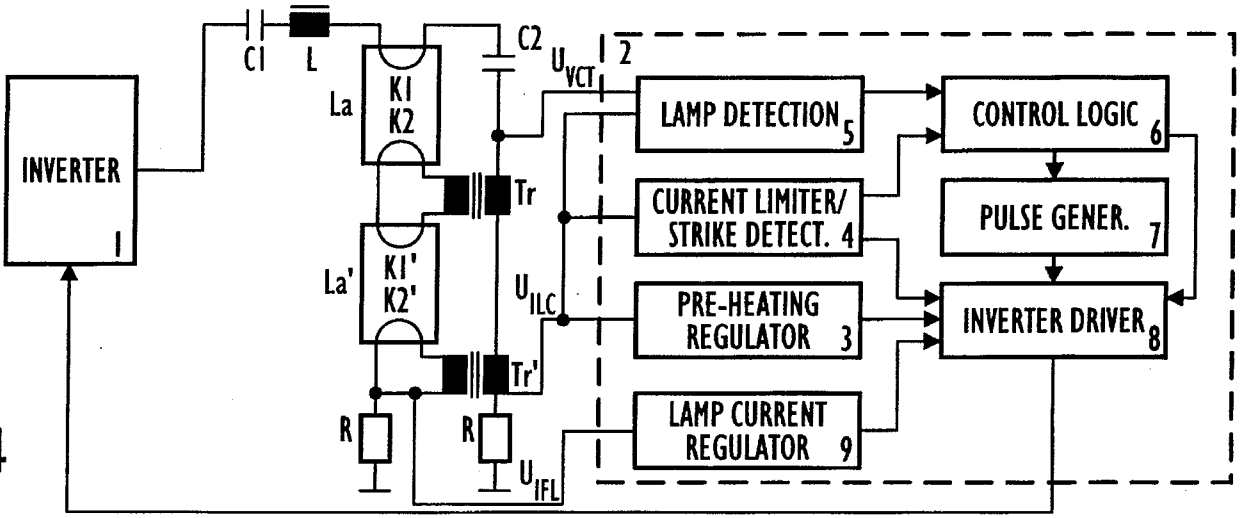
FIG. 4 is a simplified circuit diagram of a fourth embodiment of the invention.

FIG. 4 shows a fourth embodiment of a driver according to the invention and is used to drive two lamps La, La'. In contrast to the driver of FIG. 2, this driver uses a second 1:1 transformer Tr' for generating the heating current of the ground side electrode K2' of lamp La'. The lamp current is measured as a voltage drop $U_{IFL}$ over a resistor R', and the heating current is measured as a voltage drop $U_{ILC}$ over resistor R. Voltage $U_{IFL}$ is fed to lamp current regulator 9, which regulates the maximum lamp current. Voltage $U_{ILC}$ is fed, on the one hand, to the current limiter/strike detector 4, which monitors the maximum inverter current and striking of the lamps, and, on the other hand, to pre-heating regulator 3, which regulates the pre-heating current. Furthermore, $U_{ILC}$ is also fed to lamp detector 5, as already described in the FIG. 3 embodiment. By monitoring voltage $U_{ILC}$ in lamp detector 5, it is again possible to detect if K1 (and therefore lamp La) is correctly installed in the lamp circuit. If K1 is not present, voltage $U_{ILC}$ is zero during the measurement phases. However, voltage $U_{ILC}$ cannot give any indication on the presence of the second lamp La'. For this purpose, voltage $U_{VCT}$ is measured at a second reference point above transformer Tr. If one of the cathodes K2, K1' or K2' is not present or broken, no current is drawn from the secondary windings of the corresponding transformers Tr or Tr', respectively, and voltage $U_{VCT}$ increases.

Therefore, lamp detector 5 detects the absence of a lamp by testing if voltage $U_{ICL}$ is smaller than a first threshold value or voltage $U_{VCT}$ is larger than a second threshold value.

In all of the embodiments according to FIGS. 1–4, a failure of the lamps to strike during the start-up phase initiates a monitoring phase as already described with reference to the FIG. 1 embodiment. During this monitoring phase, inverter 1 is activated every 20 milliseconds to generate four pulses at 50 Khz. During the AC-current bursts generated in this way, voltage $U_{ILC}$ and (if used) voltage $U_{VCT}$ are monitored in lamp detector 5 for detecting if a lamp has been replaced. As soon a lamp replacement has been detected, a new start-up phase is initiated.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. A method for operating a driver circuit for discharge lamps, said driver circuit comprising an inverter driving a lamp circuit, wherein at least one discharge lamp is arranged in said lamp circuit, said method comprising the steps of:

attempting to cause said at least one lamp to strike during a start-up phase, and if said start-up phase fails and said lamp does not strike, performing the following steps:

performing repeated measurements during a monitoring phase, wherein, during each of said measurements, operating said inverter for a predetermined time interval;

measuring at least one voltage generated by said inverter in said lamp circuit during each of said measurements for detecting a removal or an insertion of said at least one lamp; and operating said inverter, during each measurement, to generate four pulses at a frequency of 50 kHz.

2. The method of claim 1 wherein, after a failure of said at least one lamp to strike during said start-up phase, continuing said monitoring phase until a removal and a subsequent insertion of said at least one lamp has been detected, and thereupon initiating said start-up phase.

3. The method of claim 1 further including arranging a plurality of lamps in said lamp circuit, wherein, after a failure of at least one of said lamps to strike during said start-up phase, continuing said monitoring phase until a removal of at least one of said lamps is detected, thereupon continuing said measurement phase until all of said lamps are inserted, and thereupon initiating said start-up phase.

4. The method of claim 1, further including, measuring two voltages, at two different points in said lamp circuit, during each measurement.

5. A driver for fluorescent lamps comprising:

a lamp circuit for driving at least one fluorescent lamp;

an inverter for generating an alternating voltage in said lamp circuit;

a lamp presence detector for monitoring a voltage at at least one reference point in said lamp circuit for determining a presence of said at least one lamp while said alternating voltage is applied to said lamp circuit and for generating a signal indicative of the presence of said at least one lamp;

a control circuit for controlling a start-up procedure for said at least one lamp and, if said start-up procedure fails, for intermittently operating said inverter and monitoring said signal from said lamp presence detector and for re-starting said start-up procedure upon a replacement of said at least one lamp; and arranging a heatable lamp electrode and a resistor in series in said lamp circuit, with said voltage at said at least one reference point depending on a voltage drop across said resistor.

6. A driver for fluorescent lamps comprising:

a lamp circuit for driving at least one fluorescent lamp;

an inverter for generating an alternating voltage in said lamp circuit;

a lamp presence detector for monitoring a voltage at at least one reference point in said lamp circuit for determining a presence of said at least one lamp while said alternating voltage is applied to said lamp circuit and for generating a signal indicative of the presence of said at least one lamp;

a control circuit for controlling a start-up procedure for said at least one lamp and, if said start-up procedure fails, for intermittently operating said inverter and monitoring said signal from said lamp presence detector and for re-starting said start-up procedure upon a replacement of said at least one lamp; and a transformer arranged in said lamp circuit, wherein a primary winding of said transformer is arranged in series with a first heatable lamp electrode and a secondary winding of said transformer is connected to a second heatable lamp electrode for inducing a heating current in said second heatable lamp electrode.

7. The driver of claim 6 further including a first resistor arranged in series with respect to said primary winding, wherein said lamp presence detector is utilized for determining a voltage drop across said first resistor.

8. The driver of claim 7 further including:

a second resistor arranged at said second heatable lamp electrode and in series with respect to said at least one lamp; and a lamp current regulator for determining a lamp current by measuring a voltage drop across said second resistor.

9. The driver of claim 6 further including the following components, with said components being consecutively arranged in series in said lamp circuit in the following order:

a first heatable electrode of said lamp;

a capacitor;

a second heatable electrode of said lamp; and a resistor, wherein said at least one reference point is arranged between said second electrode and said resistor.

10. The driver of claim 6 further including the following components, with said components being consecutively arranged in series in said lamp circuit in the following order:

a first heatable electrode of said lamp;

a capacitor;

a first winding of a transformer; and a resistor, wherein a second winding of said transformer is arranged in series with respect to a second heatable electrode of said lamp and wherein a first reference point is arranged between said first winding of said transformer and said resistor.

11. The driver of claim 10 further including a second reference point, with said second reference point being arranged between said first winding of said transformer and said capacitor.

12. The driver of claim 6 further including, arranging two lamps in said lamp circuit and consecutively arranging the following components in series in said lamp circuit in the following order:

a first heatable electrode of a first lamp;

a capacitor;

a first winding of a transformer;

a first heatable electrode of a second lamp; and a resistor, wherein a second winding of said transformer is arranged in series with respect to both a second heatable electrode of said first lamp and a second heatable electrode of said second lamp and wherein a first reference point is arranged between said first heatable electrode of said second lamp and said resistor.

13. The driver of claim 12 further including a second reference point, with said second reference point being arranged between said first winding of said transformer and said capacitor.

14. The driver of claim 6 including arranging two lamps in said lamp circuit and further including consecutively arranging the following components in series in said lamp circuit in the following order:

a first heatable electrode of a first lamp;

a capacitor;

a first winding of a first transformer;

a first winding of a second transformer; and a resistor, wherein a second winding of said first transformer is arranged in series with respect to a second heatable electrode of said first lamp and a second heatable electrode of a second lamp, wherein a second winding of said second transformer is arranged in series with respect to a first heatable electrode of said second lamp, and wherein a first reference point is arranged between said first winding of said second transformer and said resistor.

15. The driver of claim 14 further including a second reference point, with said second reference point being arranged between said first winding of said first transformer and said capacitor.

16. The driver of claim 6 further including a transformer, wherein a first winding of said transformer is arranged in said lamp circuit and a second winding of said transformer drives an auxiliary circuit, wherein said at least one lamp comprises at least one heatable electrode arranged in said auxiliary circuit in series with respect to said second winding, and wherein said control circuit comprises means for determining a voltage drop across said first winding of said transformer.

17. A driver for fluorescent lamps comprising:

a lamp circuit for receiving at least one fluorescent lamp, said lamp circuit comprising a transformer and a resistor;

an inverter for generating an alternating voltage in said lamp circuit; and a lamp presence detector for monitoring a voltage drop across said resistor for determining a presence of said at least one lamp while said alternating voltage is applied to said lamp circuit and for generating a signal indicative of the presence of said at least one lamp, wherein said resistor is arranged in series with respect to a primary winding of said transformer, between said primary winding and a ground potential, and wherein a secondary winding of said transformer is connected to a ground-side electrode of said at least one lamp for inducing a heating current in said ground-side electrode.

* * * * *